US008215791B2

(12) United States Patent
Feinbloom et al.

(10) Patent No.: US 8,215,791 B2
(45) **Date of Patent: *Jul. 10, 2012**

(54) ILLUMINATING HEADLAMP PROVIDING SUBSTANTIALLY UNIFORM ILLUMINATION

(75) Inventors: Richard E. Feinbloom, New York, NY (US); Kenneth Braganca, Ronkonkoma, NY (US); Peter Yan, Rego Park, NY (US)

(73) Assignee: Designs for Vision, Inc., Ronkonkoma, NY (US)

( * ) Notice: Subject to any disclaimer, the term of this patent is extended or adjusted under 35 U.S.C. 154(b) by 238 days.

This patent is subject to a terminal disclaimer.

(21) Appl. No.: 12/658,025

(22) Filed: Feb. 1, 2010

(65) Prior Publication Data

US 2010/0165605 A1 Jul. 1, 2010

Related U.S. Application Data

(63) Continuation of application No. 12/074,370, filed on Mar. 3, 2008, now Pat. No. 7,690,806.

(60) Provisional application No. 60/921,150, filed on Mar. 30, 2007.

(51) Int. Cl.
*F21V 5/00* (2006.01)

(52) U.S. Cl. ..... 362/190; 362/105; 362/308

(58) Field of Classification Search ..... 362/105, 362/187, 190, 191, 308
See application file for complete search history.

(56) References Cited

U.S. PATENT DOCUMENTS

| | | | |
|---|---|---|---|
| 5,440,462 | A | 8/1995 | Kim |
| 5,722,762 | A | 3/1998 | Soll |
| 6,290,368 | B1 | 9/2001 | Lehrer |
| 6,461,024 | B1 | 10/2002 | Becker |
| 6,955,444 | B2 | 10/2005 | Gupta |
| 2004/0264175 | A1 | 12/2004 | Willoughby |
| 2005/0099824 | A1 | 5/2005 | Dowling |

OTHER PUBLICATIONS

Zeon LED Portable High Definition Light System, Website print-out from www.orascoptic.com (Mar. 2007) (2 pages).

*Primary Examiner* — Laura Tso
(74) *Attorney, Agent, or Firm* — Law Office of Carl Giordano, PA

(57) ABSTRACT

An illuminating headlamp consisting of a headband and at least one optical device providing illumination at a known distance from said optical device attached to said headband. Each optical device consists of a housing having an open first end and an open second end. There is a light emitting device attached to a mounting which is attached to the second end causing said light emitting device to be orientated at a known angle to an axis of said housing. At least one optically transparent lens is incorporated into said first end, and a means for adjusting said optically transparent lens in order to cause a focal point of the lens to be positioned behind said light emitting device, wherein a zone of substantially uniform illumination is projected at said known distance.

18 Claims, 13 Drawing Sheets

ILLUMINATING HEADLAMP PROVIDING SUBSTANTIALLY UNIFORM ILLUMINATION

CLAIM OF PRIORITY

This application is a continuation of, and claims priority from, application Ser. No. 12/074,370, filed on Mar. 3, 2008, now U.S. Pat. No. 7,690,806 titled: ILLUMINATING HEADLAMP PROVIDING SUBSTANTIALLY UNIFORM ILLUMINATION, and claims the benefit of the earlier filing date, pursuant to 35 USC §119(e), to that patent application entitled "Illuminating Headlamp and Method of Illumination," filed in the US Patent and Trademark Office, on Mar. 30, 2007, and afforded Ser. No. 60/921,150 and pursuant to 35 USC §120 to that patent application entitled "Illumination Assembly," filed on Oct. 18, 2007 and afforded Ser. No. 11/975,194, the contents of each of which are hereby incorporated by reference herein.

FIELD OF THE INVENTION

Illumination devices are employed in a wide variety of contexts. Various types of fine work require high intensity illumination over a small area at a relatively short distance from the eyes of a user. Examples of such fine work include surgery, dentistry and watch and jewelry repair. Illuminating headsets are suited for these types of work as they allow a light to be projected at an area while leaving the hands free to manipulate tools or surgical equipment.

Prior art headsets typically have a remote source of illumination connected by a fiber optic cable to the headset. The remote source of illumination is typically a bulb, which may be, for example, a metal halide or a xenon bulb. A suitable lens is provided to couple the bulb output to a fiber optic cable, in the headset. While the fiber optical cable attached to the headset is cumbersome and may be inconvenient to the user, the power requirements and heat output of metal halide and xenon bulbs make it impractical for these illumination sources to be mounted on the headset.

In the prior art, the use of light-emitting diodes as a light source has been suggested. U.S. Pat. No. 6,955,444, to Gupta, discloses the use of a headlamp with two LEDs. Each LED is mounted relative to a reflector to provide sufficient illumination on a target region. However, reflectors typically provide a diffuse illuminated region. The use of two LEDs also adds weight, cost and complexity to the device.

US Published Patent Application serial no. 2005/0099824, to Dowling, also discloses the general concept of integrating an LED into a headlamp. However, this patent application provides little detail as to implementation. Another example in the prior art is the Zeon® LED Portable High-Definition Light, available from Orascoptic, 3225 Deming Way, Suite 190, Middleton, Wis. 53562. This device incorporates a LED mounted in front of reflectors. A collimator captures the light from the LED. The use of the collimator captures a maximum percentage of the light emitted by the LED. However, illumination is not uniform over the target area. Rather the intensity of illumination peaks at the center and then gradually decreases with distance from the center of the illuminated area.

However, this decrease in the illumination from the center of the target area is disconcerting as it limits the illuminated field of view. Hence, there is a need in the industry for an illuminated headset that provides a target area or zone of substantially uniform illumination.

SUMMARY THE INVENTION

An illuminating headlamp consisting of a headband and at least one optical device providing illumination at a known distance from said optical device attached to said headband. Each optical device consists of a housing having an open first end and an open second end. There is a light emitting device attached to a mounting which is attached to the second end causing said light emitting device to be orientated at a known angle to an axis of said housing. At least one optically transparent lens is incorporated into said first end, and a means for adjusting said optically transparent lens in order to cause a focal point of the lens to be positioned behind said light emitting device, wherein a zone of substantially uniform illumination is projected at said known distance.

BRIEF DESCRIPTIONS OF THE FIGURES

The advantages, nature, and various additional features of the invention will appear more fully upon consideration of the illustrative embodiments now to of the described in detail in connection with accompanying drawings where like reference numeral to identify like element throughout the drawings.

DETAILED DESCRIPTION

It is to be understood that the figures and descriptions of the present invention described herein have been simplified to illustrate the elements that are relevant for a clear understanding of the present invention, while eliminating, for purposes of clarity many other elements found in illuminating headsets. However, because these elements are well-known in the art, and because they do not facilitate a better understanding of the present invention, a discussion of such element is not provided herein. The disclosure herein is directed to also variations and modifications known to those skilled in the art.

Figure 1:
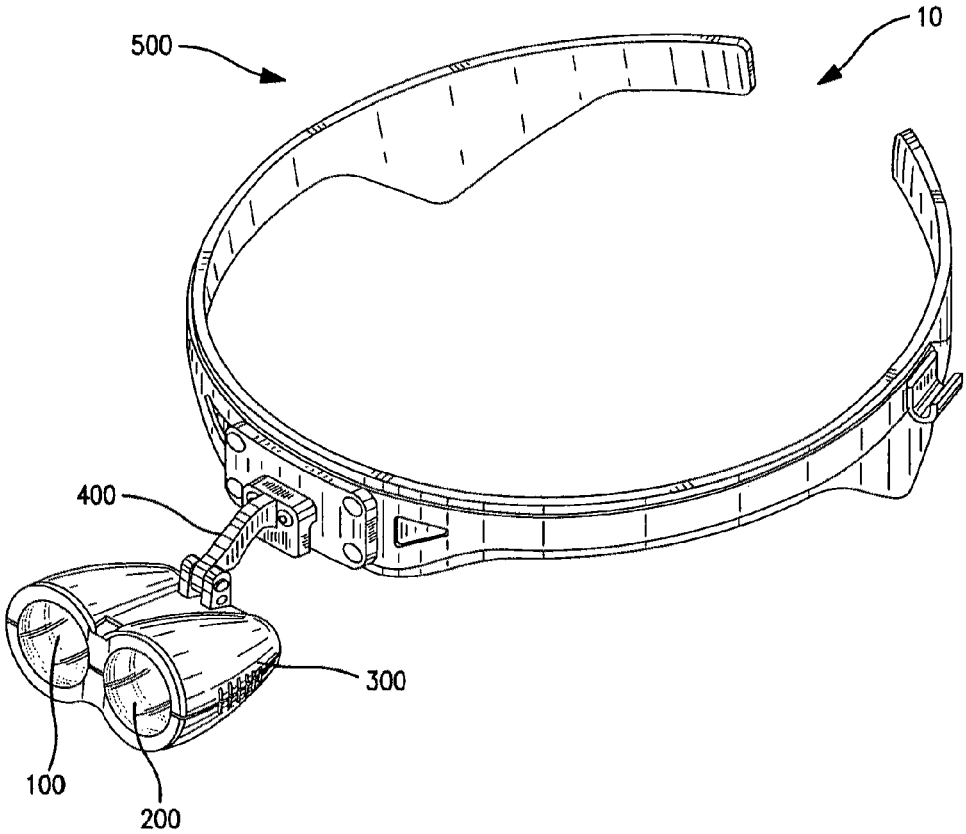
FIG. 1 represents a perspective view of an illuminating headset.

FIG. 1 represents an illuminating headset assembly. Headband assembly 10 includes generally two light emitting units, or illumination devices, 100, 200 within housing 300. Illumination devices 100, 200 are supported relative to one another with housing 300, which is attached to assembly 10 by bar 400. Illumination devices 100, 200 are adapted to emit light in relatively narrow beams that intersect and entirely or substantially overlap at a selected distance from the illumination devices. Headband 500 supports housing 300 including illumination devices 100, 200.

Although headband assembly 10 is shown to include two light-emitting devices, it would be appreciated that assembly 10 may also be constructed to include only a single light-emitting device. As the principles of operation of the light-emitting devices 100, 200 are generally identical; a description of only one of the devices will be described in detail herein.

Figure 2A:
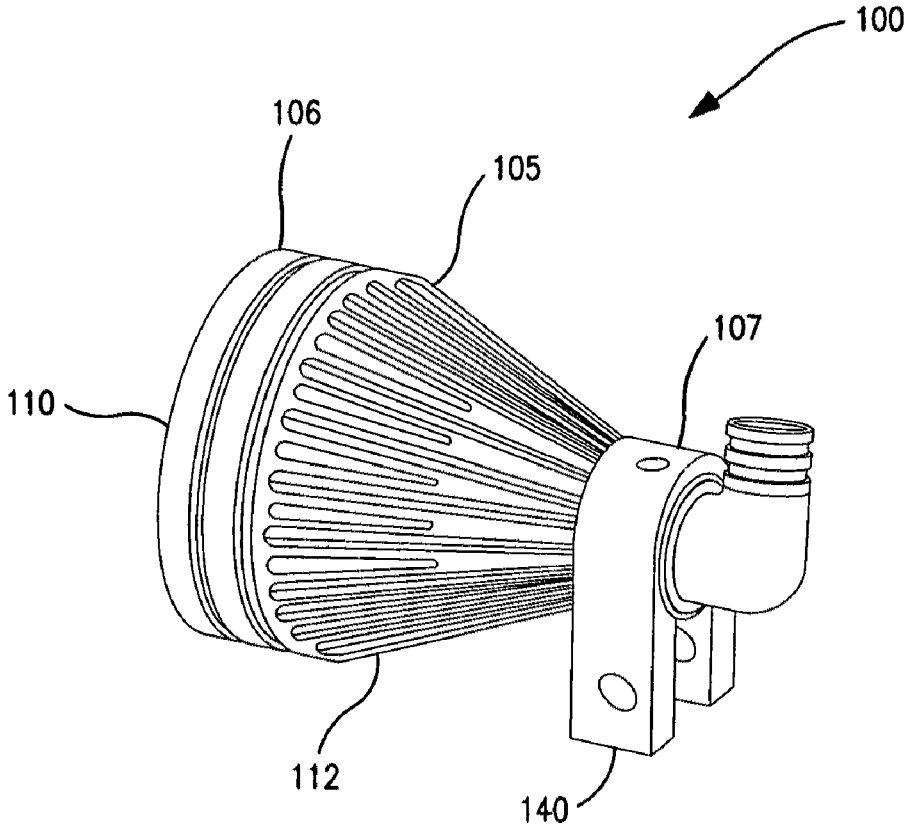
FIG. 2A represents an isometric drawing of an exemplary LED holding device in accordance with the principles of the invention.
Figure 2B:
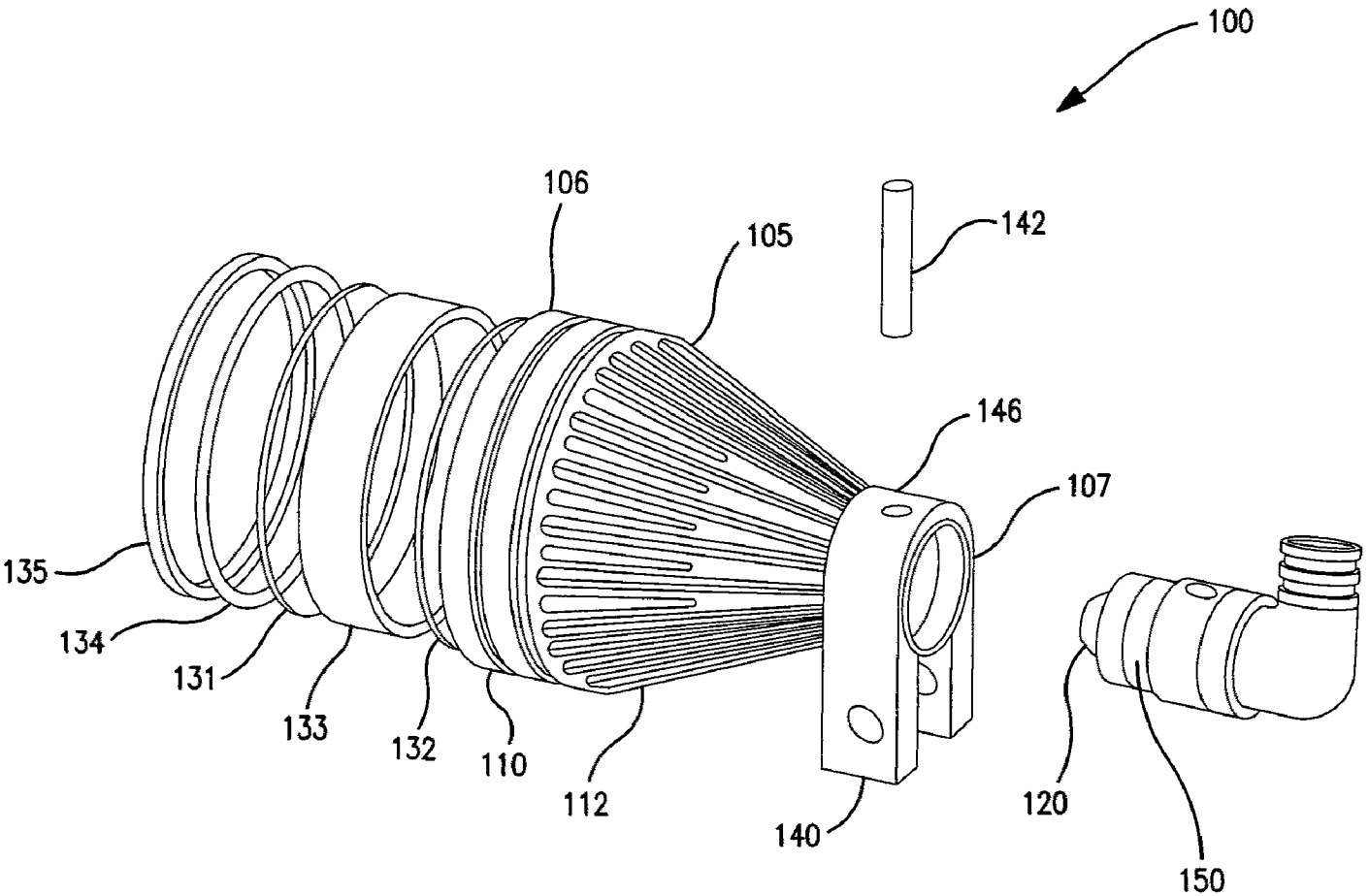
FIG. 2B represents an exploded view of the device shown in FIG. 2A.

FIG. 2A represents a single one of the light-emitting devices 100, 200 of an illuminated headset in accordance with the principles of the invention. FIG. 2B represents an exploded view of the device 100 (or 200) shown in FIG. 2A.

Referring to FIG. 2A, device 100 is an illuminating device having an opaque housing 105 having a distal end 106 and a proximal end 107, an opening 110 at the distal end 106 and a tapering portion 112 intermediate the distal end 106 and the proximal end 107. Referring to FIG. 2B, a light emitting diode 120 is mounted within a mounting 150 that is positioned in housing 105 near the proximal end 107. The light emitting diode is positioned to emit light toward opening 110. Lenses 131, 132 are positioned in housing 105 distally from the light emitting diode 120 to receive and retransmit through opening 110 a portion of the emitted light. Lenses 131, 132 allow the focusing or defocusing of light emitted from light emitting diode 120. Lenses 131, 132 may be adjusted to provide a zone of substantially uniform illumination at a known distance from the distal end of device 100.

Referring to FIG. 2B, lenses 131, 132 may be held in place by sleeve 133, o-ring 134 and closing-ring 135. Lenses 131, 132 may be spherical or aspherical and may be of a glass composition with or without a plastic coating. Epoxy may be employed to fix lenses 131, 132 to sleeve 133. Although only two lenses are illustrated, it would be recognized that the number and selection of lenses may be varied without altering the scope of the invention.

Mounting bracket 140 is attached to housing 105 near the proximal end of assembly 100. Mounting bracket 140 is an example of a bracket adapted to be attached to a headband 500 (FIG. 1) so that device 100 may be mounted on the head of a user. Mounting bracket 140 is shown having a body with an opening therethrough to receive the proximal end 107 of housing 105.

Mounting pin 142 may be inserted into bore 146 and into corresponding bores in housing 110 and a bore 144 in LED mount 150 (see FIG. 8) to secure housing 105, mounting bracket 140 and LED mount 150 relative to one another.

LED mount 150 may be in physical contact with housing 105 or otherwise configured to provide good heat conduction from mount 150 to housing 105. LED mount 150 may be selected from a material that is a good heat conductor. For example, mount 150 may be a copper or a tellurium copper alloy. Housing 105 may be made of a similarly good heat conductor, e.g., copper or aluminum. In one aspect, an uneven outer surface of housing 105 may be provided, as illustrated. Such uneven surface may be represented as grooves defined in the outer surface of housing 105. The uneven surface increases the surface area and, hence, the spread the heat over a greater surface area. In any event, the surface can also be smooth.

Although device 100 shown in FIGS. 2A and 2B is shown having a conical shape, it would be recognized by those skilled in the art that this illustrates a preferred embodiment of the invention and that other shapes, e.g., cylindrical, are currently contemplated and considered to be within the scope of the invention.

Figure 3A:
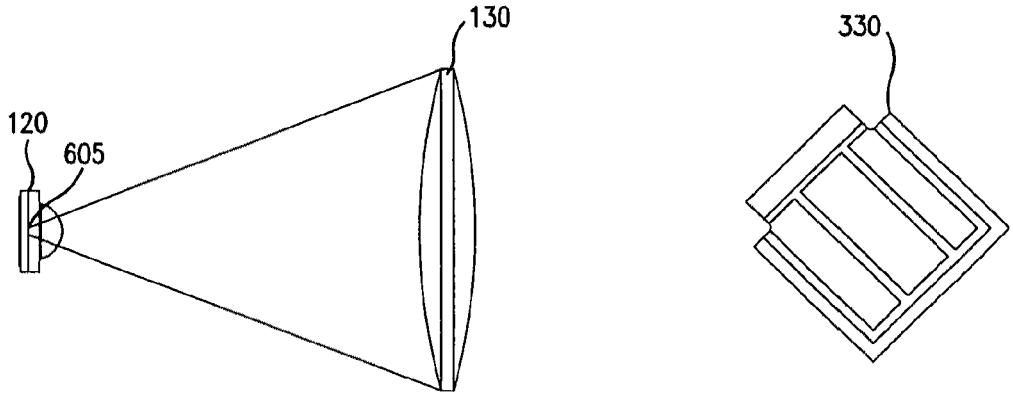
FIGS. 3A-3C represent simplified exemplary ray diagrams associated with the device shown in FIG. 1.
Figure 3B:
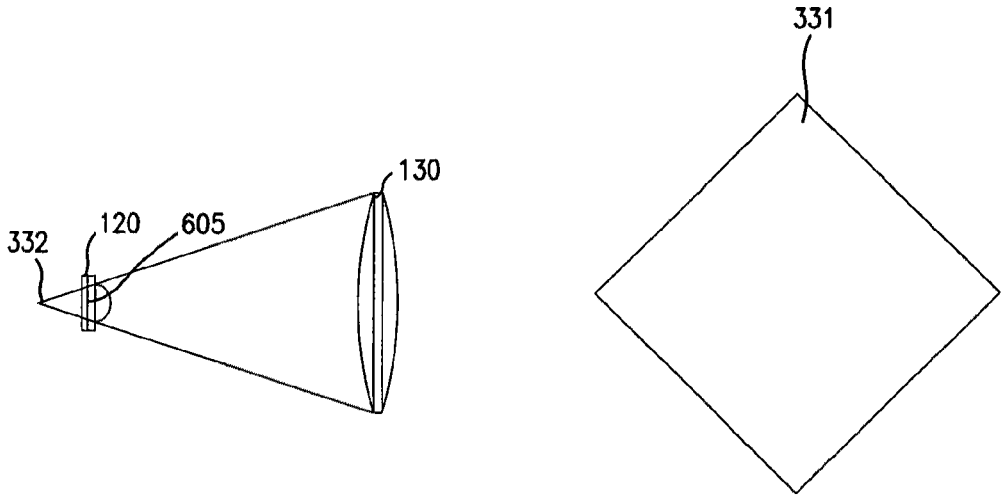
Figure 3C:
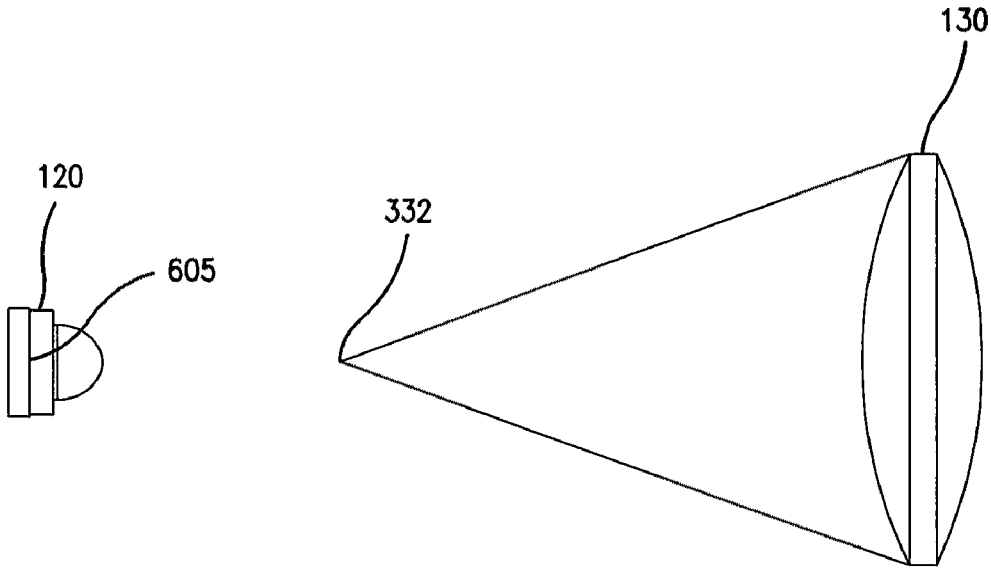

FIGS. 3A-3C represent simplified exemplary ray diagrams associated with the device shown in FIGS. 2A and 2B. It will be appreciated that lenses associated with lens 130 are merely schematic and may include a plurality of lenses and/or reflectors. Emitter 120 represents a plurality of light emitting diodes arranged in an array 605. Array 605 may have a pattern as shown in, and described in further detail with regard to a discussion of, FIG. 4.

Referring to FIG. 3A, lens 130 is positioned relative to array 605 with its focal point on array 605 so as to project a focused image of array 605 on an incident or target area 330. Because of the placement of array 605 at the focal point of lens 130, details of the array may be seen in within the target image. This focused image is undesirable as it fails to provide a substantially uniform illumination within the target area.

Figure 6A:
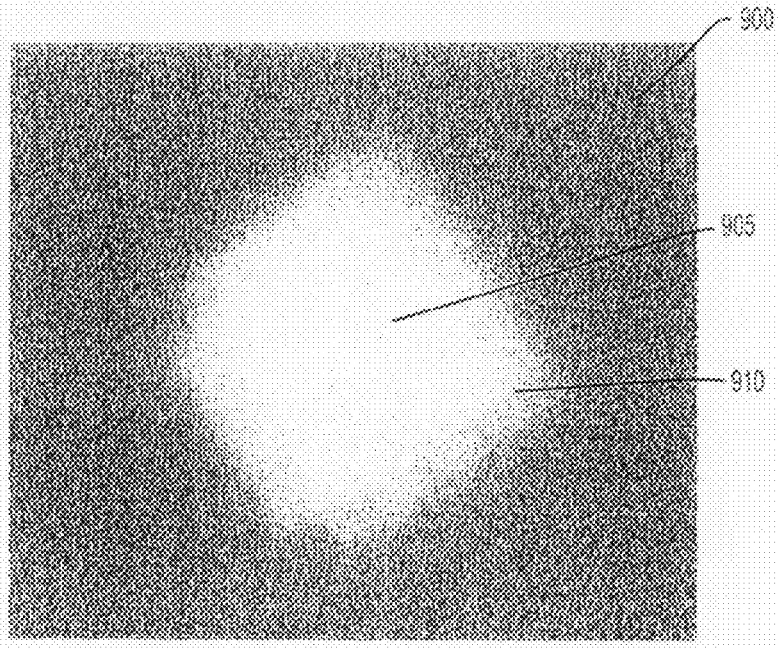
FIGS. 6A and 6B represent exemplary illuminated areas associated with focus-ed and defocus-ed operation of the device shown in FIG. 1.
Figure 6B:
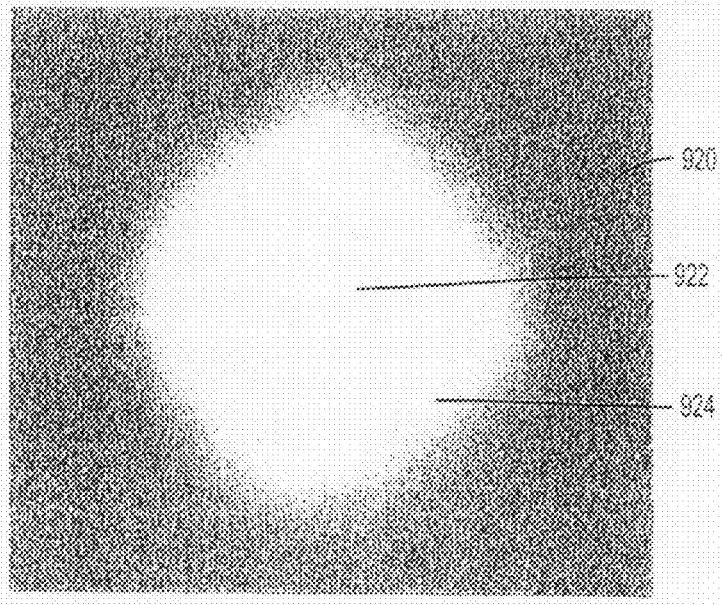

Referring to FIG. 3B, lens 130 is configured so that its focal point, identified as 332 is behind array 605. In this case, the defocusing of the light generated by array 605 causes a defocused image 331 to be projected on a target area at the same distance as shown in FIG. 3A. The defocused image provides a distinct zone of substantially uniform illumination without displaying the pattern of array 605. The illuminated area of image 331 is larger than the focused image 330 shown in FIG. 3A and has a higher intensity of illumination. Image 331 has a generally rectangular form, as array 605 is generally rectangular, in this illustrated example. Examples of a focused image of an array and a defocused image of an array projected on a target area are shown in FIGS. 6A and 6B, respectively.

FIG. 3C illustrates a configuration wherein the focal point 332 of lens 130 is positioned in front of array 605. This arrangement provides a blurred image of the array with indistinct edges and great variation in intensity. The image provides less uniformity and lower intensity than the defocused image shown in FIG. 3B.

As shown in FIGS. 3A-3C and FIGS. 6A and 6B, a defocused image has a larger area, a more even illumination and a higher intensity of illumination when compared to a focused image of emitter array 605. It will be appreciated that superposition of defocused images of multiple arrays results in both higher illumination intensity and better uniformity of illumination across the illuminated area. In an exemplary embodiment shown, an intensity of about 7,000 foot-candles may be obtained across a field. Devices for providing such intensity are manufactured by Cree with headquarters located in Durham, N.C. The device is sold as the Cree P3 LED: P/N XREWHTL1-0000-07-01 which provides intensity of 7,000 fc at 13" working distance. The intensity is measured with a Gossen Panlux Light Meter. P/N 3B14095 (Gossen is located in Germany).

Figure 4:
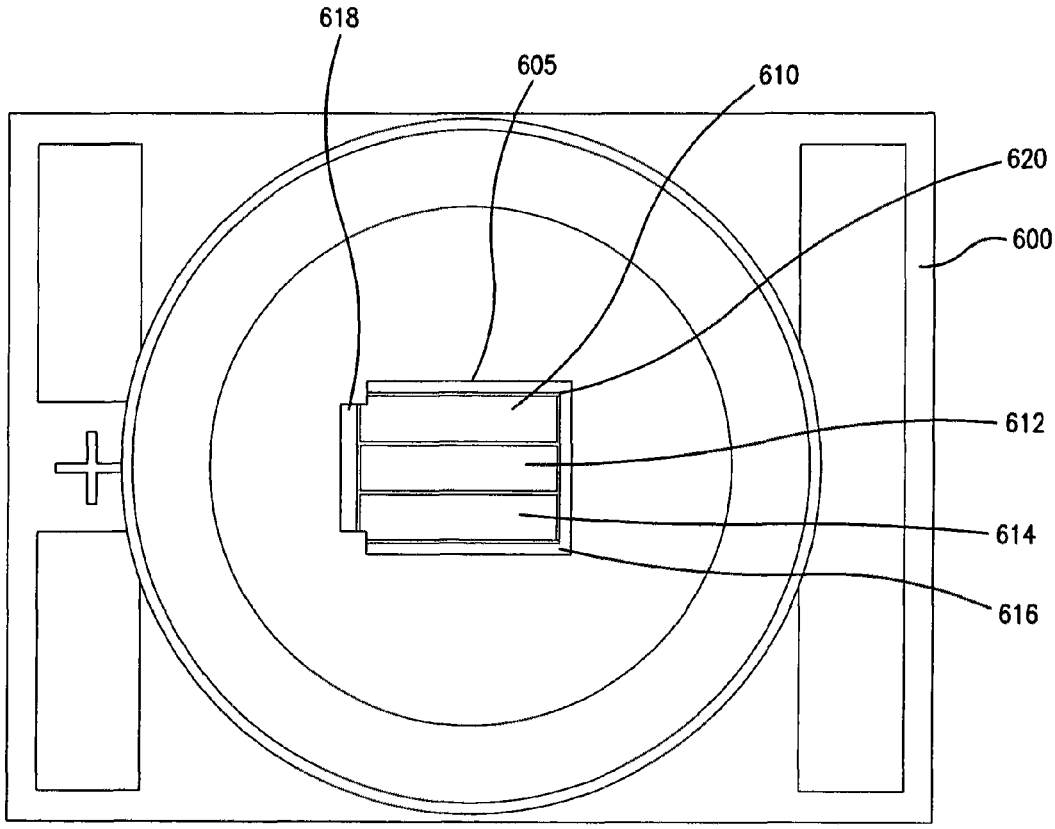
FIG. 4 represents a top view of a LED shown in an array shape suitable for use in the device shown in FIG. 1.

FIG. 4 represents an exemplary LED emitter assembly 600 incorporated into the optical device shown in FIG. 2A. Individual LEDs maybe a Cree XLamp High-Power LED, available from Arrow Electronics, Manalapan, N.J. Array 605 is a two-dimensional array having an overall generally rectangular shape. The array 605 may be on a single die or on more than one die. Generally rectangular sub-arrays 610, 612, 614 and elongated sub-array 616, 618 emit light. These sub-arrays may include individual diode elements that are relatively closely spaced together. For example, the diodes may be spaces at 400 dots per inch (dpi) or 1200 dpi. Relatively narrow areas 620, which may contain controllers and other devices, for example do not emit light.

As discussed with regard to FIG. 3A, a focused projection of array 605 will result in an image with projections of sub-arrays 610, 612, 614, 616 and 618 being bright with dark lines corresponding to areas 620. Furthermore, variations in light output intensity within sub-array areas may occur. Such variation may occur as a result of errors in manufacturing of the LED sub-arrays. As a result of the pattern of variations in intensity, when a focused image of array 605 is projected onto an incident or target area, noticeable variations in illumination intensity occur (see FIG. 6A).

However, when a defocused image, as discussed with regard to FIG. 3B, is projected onto a target area, variations in illumination intensity are reduced so as to create a zone of substantially uniform illumination as seen in FIG. 6B.

Figure 5:
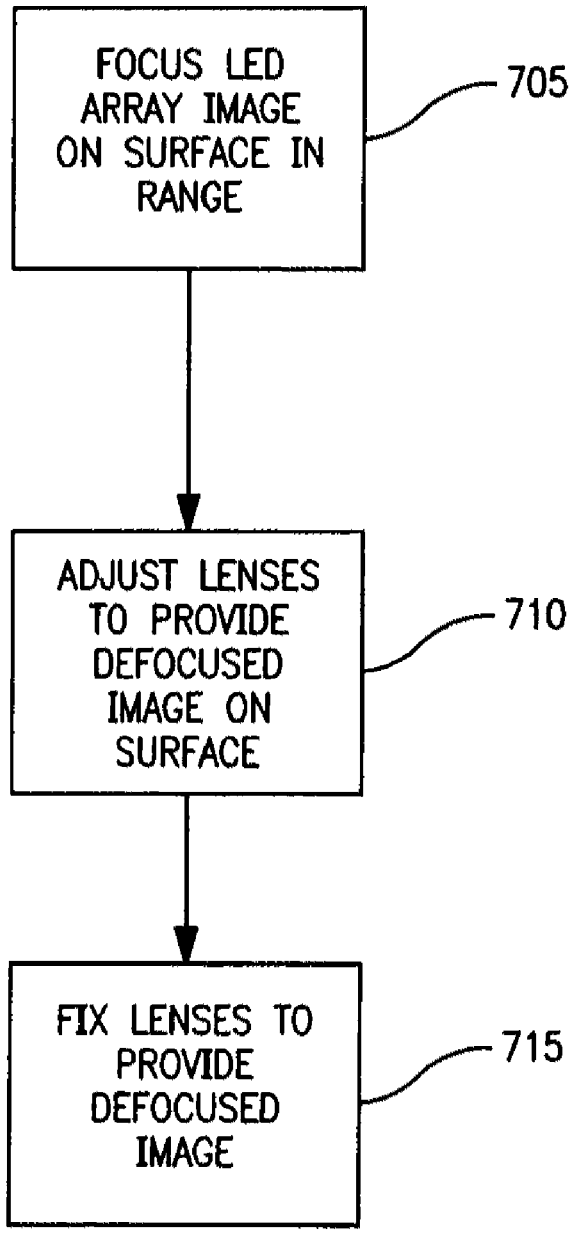
FIG. 5 represents a process flow diagram of a method of operation of the device shown in FIG. 1.

FIG. 5 illustrates a method for providing a zone of substantially uniform illumination utilizing the optical devices as shown in FIG. 2A when incorporated into the illuminated headset shown in FIG. 1. In this exemplary process, an incident plane, such as an opaque sheet, is placed at a desired distance from the illuminated headset 10. The illumination device 100 (200) is activated and an image projected onto the incident place is paced into focus. The projected image of the emitting array may appear to include at least one distinct illuminated area and may have relatively sharp edges. (block 705). The lens or lenses (130, 132) are then adjusted until a defocused image is obtained, as indicated by block 710 and fixed at block 715. Lens adjustment may include changing the distance between the lens 130 (FIG. 2A) and the array 605, changing the distance between lenses 131 and 132, substituting different lenses or adding or removing lenses. As shown n FIG. 3B, the adjustment causes the focal point of the lenses to be behind the array 605 (defocused).

In one aspect, a light meter may be positioned at the desired distance and the lenses may be adjusted until the illumination intensity detected by the light meter is substantially at a maximum. With each lens adjustment, the area of illumination at the selected distance may also be checked to determine when the area is a minimum desired size. It will also be appreciated that different LEDs may be selected.

FIG. 6A illustrates the projection 900 of a focused image of array 605 onto a target area at a desired distance from optical device 100. As discussed previously, narrow, non-light emitting regions 910 of array 605 are discernable from the illuminated area 905. In addition, the edges of the illuminated area are less intense than that of the center region.

FIG. 6B illustrates the projection 920 of a defocused image of array 605 onto a target area at a desired distance from optical device 100. As discussed previously, the illumination across the target area is substantially uniform as denoted by the intensity at the center point 922 and edge point 924.

Figure 7A:
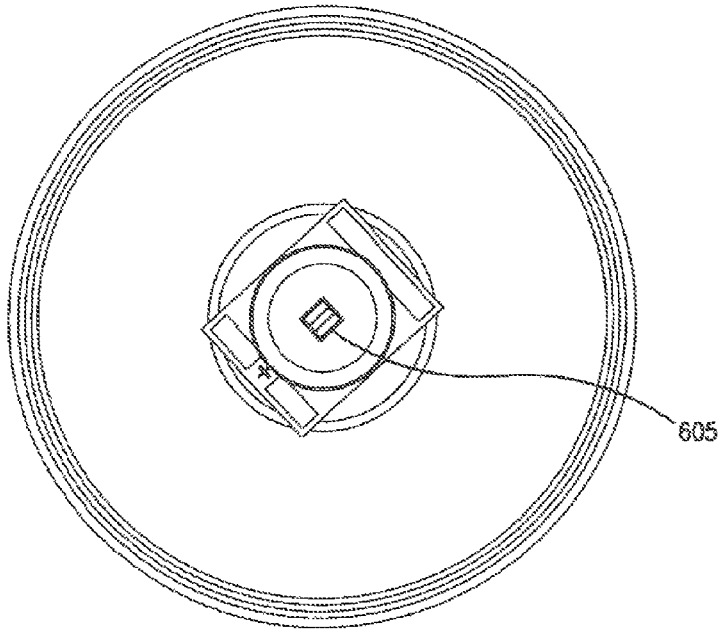
FIGS. 7A and 7B represent exemplary orientation of emitter arrays relative to a single optical device and an assembly as shown in FIG. 1.

FIG. 7A illustrates a front view of the exemplary optical device 100 shown in FIG. 2A. In this exemplary illustration, the orientation of emitter array 605 is preferably selected be to at an angle of substantially 45 degrees to a transverse axis (not shown) of the devices. The angle of 45 degrees is selected to illuminate an area at a selected distance from the assembly to project an image that is substantially square. Otherwise, the projected illumination may have a wider range in one direction (e.g., horizontal) as opposed to another direction (e.g., vertical). If the angle is changed, then other geometric configurations can be accommodated. For example, at an angle of 90 degrees, the configuration would be a square.

Figure 7B:
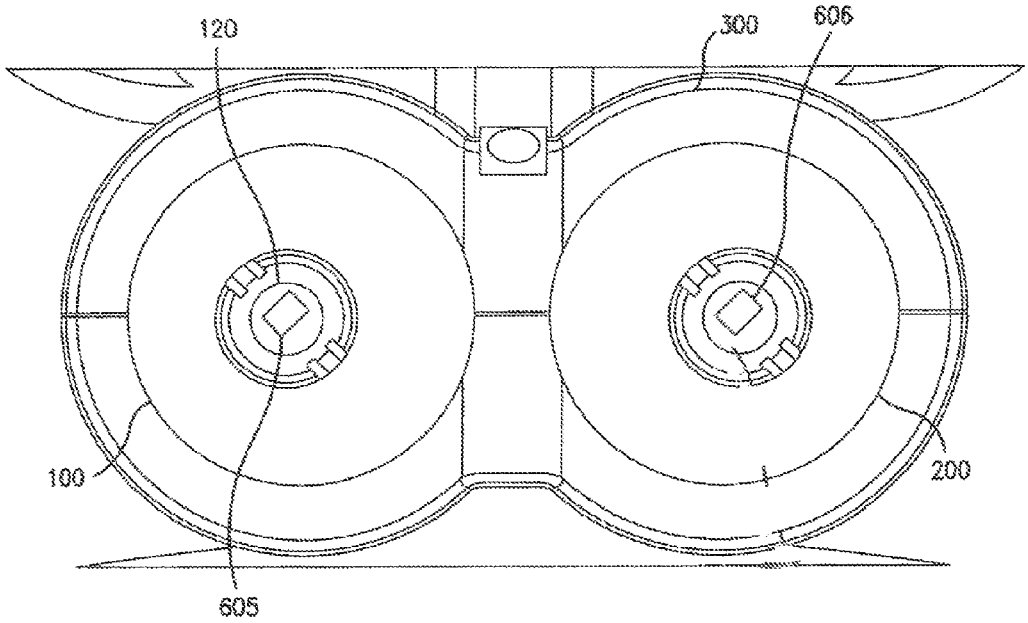

FIG. 7B illustrates a front view of the incorporation of the optical device shown in FIG. 2A in an assembly 300 shown in FIG. 1. In this embodiment, the optical devices 100, 200 are oriented along a horizontal axis of assembly 300. In this illustrated embodiment, the diode arrays 605, 606 are shown having the same orientation to the horizontal axis of assembly 300. The preferred orientation of the array 605 with regard to an axis of assembly 300 is selected for the reasons similar to that discussed above. Although, the arrays 605, 606 are shown in the same orientation, it would be understand that the orientation of the arrays 605, 606 may be independently selected and that other orientations, as well as other emitter array shapes, within the optical device have been contemplated and considered to be within the scope of the invention.

Figure 8:
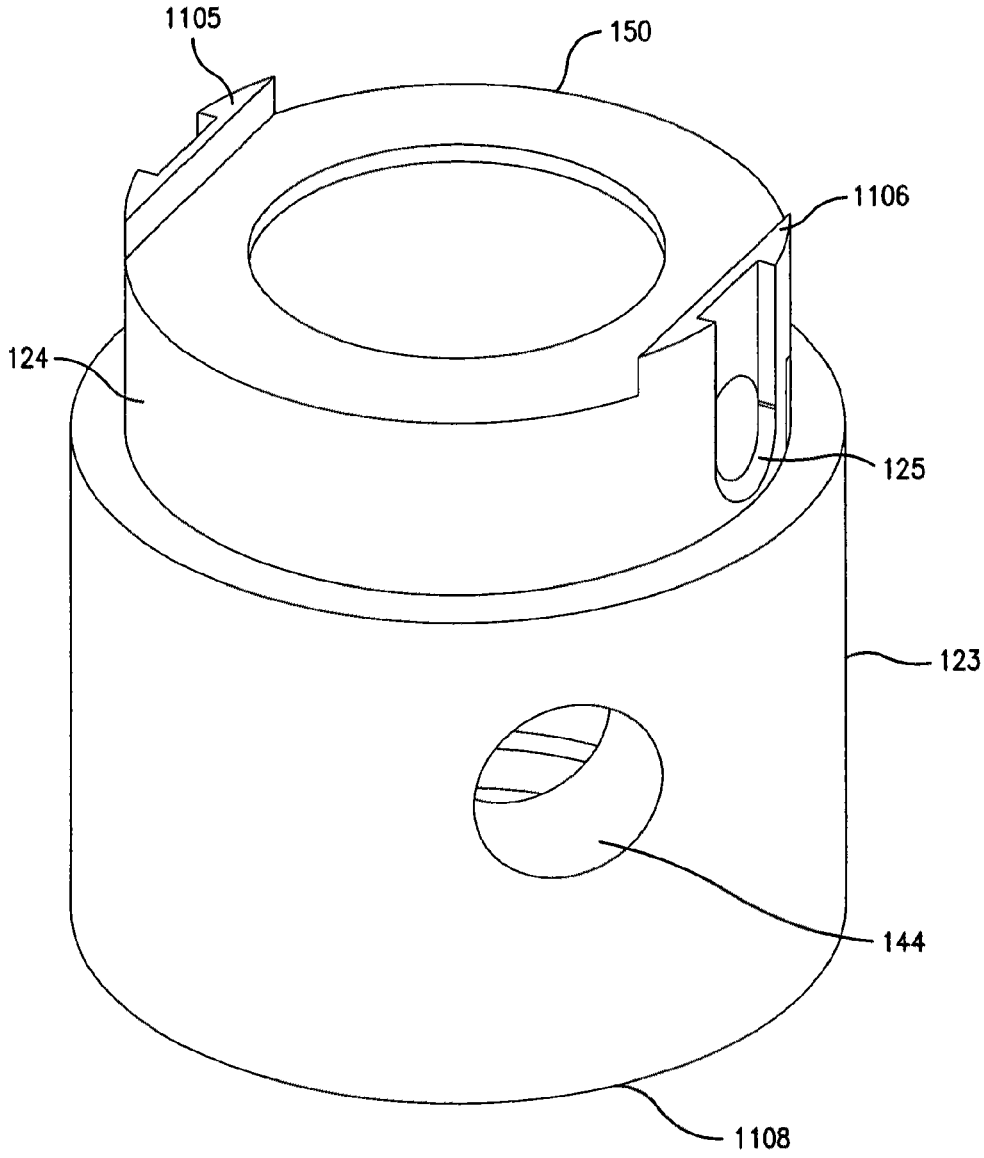
FIG. 8 illustrates an exemplary emitter mount of use in the assembly shown in FIG. 2 in accordance with the principles of invention.

FIG. 8 illustrates an exemplary mount 150 in accordance with the principles of the invention. Mount 150 is preferable selected from materials that act as a good heat conductor, e.g., copper or tellurium copper alloy. Mount 150 is generally a cylindrical hollow body, closed at one end by wall 1108, which provides a platform for emitter array 605, and open at the other end. Major cylindrical wall 123 has a bore 144 through a central axis and a corresponding opposite bore (not shown) along an axis through the central axis of end cylindrical wall 124. End cylindrical wall 124 is coaxial with, and of lesser diameter than major cylindrical wall 123 and the two walls are joined by a shoulder. End wall 1108 has upstanding members 1105, 1106 at opposite sides, positioned to retain a LED array 605 at a selected orientation relative to bore 144. End wall 1108 lies in a plane substantially parallel to the axis of bore 144. Bore 125 provides for wiring that allows connection of array 605 (not shown) to a power source.

Upstanding members 1105, 1106 on surface 1108 are positioned to provide a selected orientation of a LED array (not shown) having a rectangular base and a generally rectangular shape, so that the sides of the LED array are parallel to the sides of the base and that the sides of the array are at an angle substantially 45 degrees relative to the central axis of bore 144 and the bore opposite thereto through major wall 123. As a result of the orientation of pins 321, 322 (FIG. 9A) in bore 144 (and corresponding not shown opposite bore hole) of emitter mount 150, the angle between the axis of bore 144 (and corresponding not shown opposite bore hole) and the sides of array 605 (not shown) when mounted on emitter mount 150, is fixed at a substantially 45 degree angle relative to a horizontal axis.

Figure 9A:
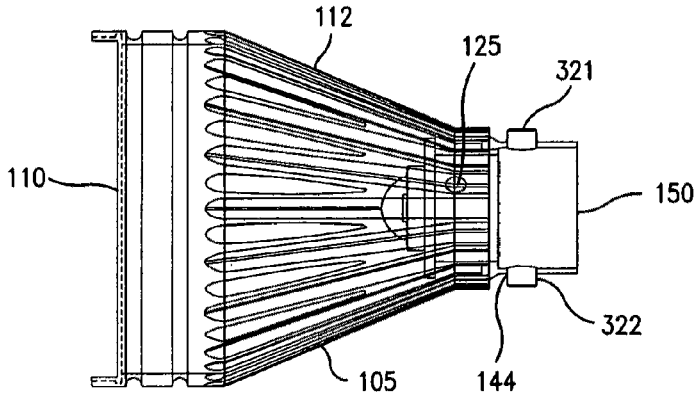
FIGS. 9A-9C illustrate views of the relationship of the light-emitting array in the mounting shown in FIG. 8.
Figure 9B:
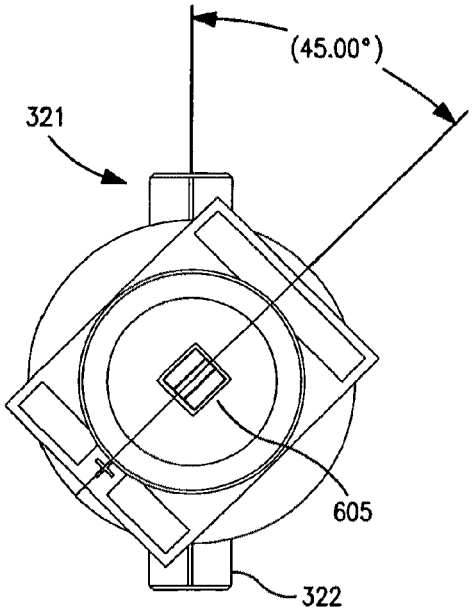
Figure 9C:
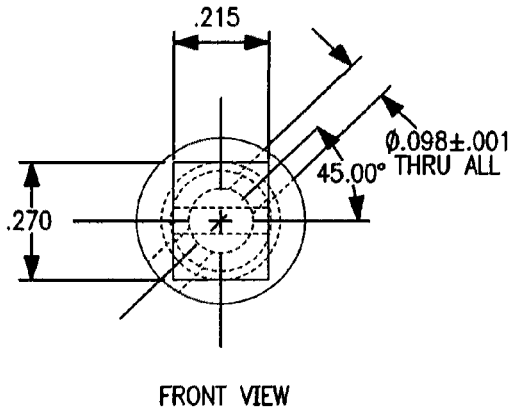
Figure 10A:
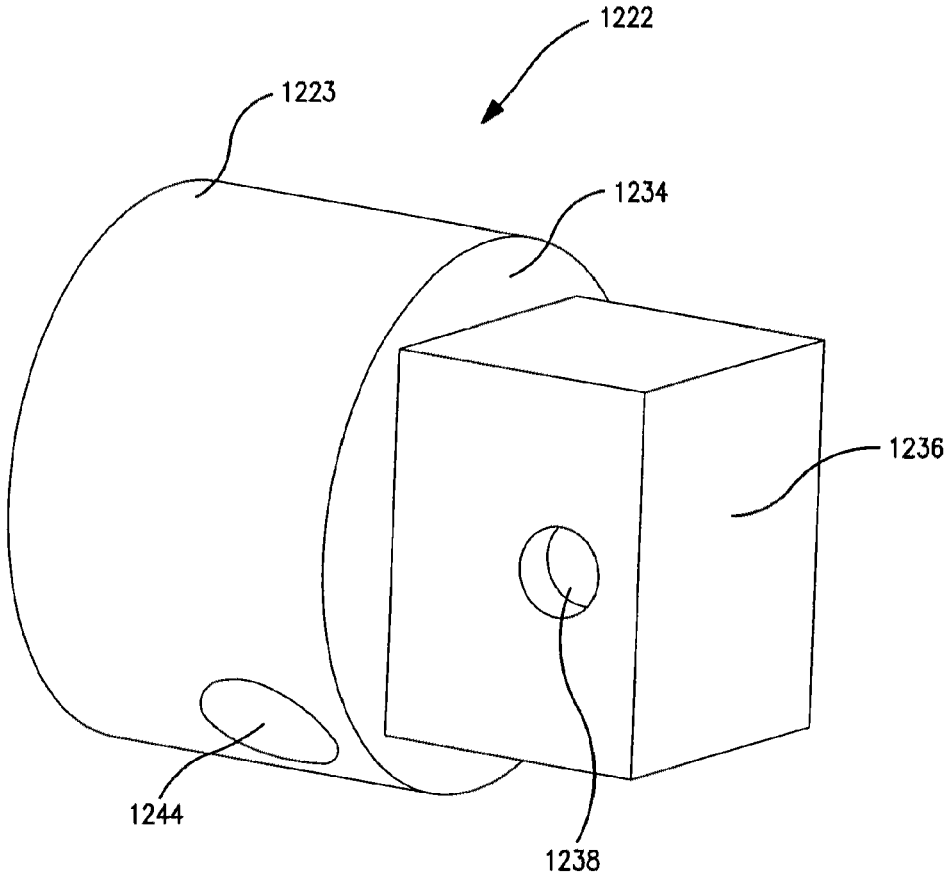
FIGS. 10A-10D illustrate views of an alternate emitter for use in the assembly shown in FIG. 2 in accordance with the principles of the invention.
Figure 10B:
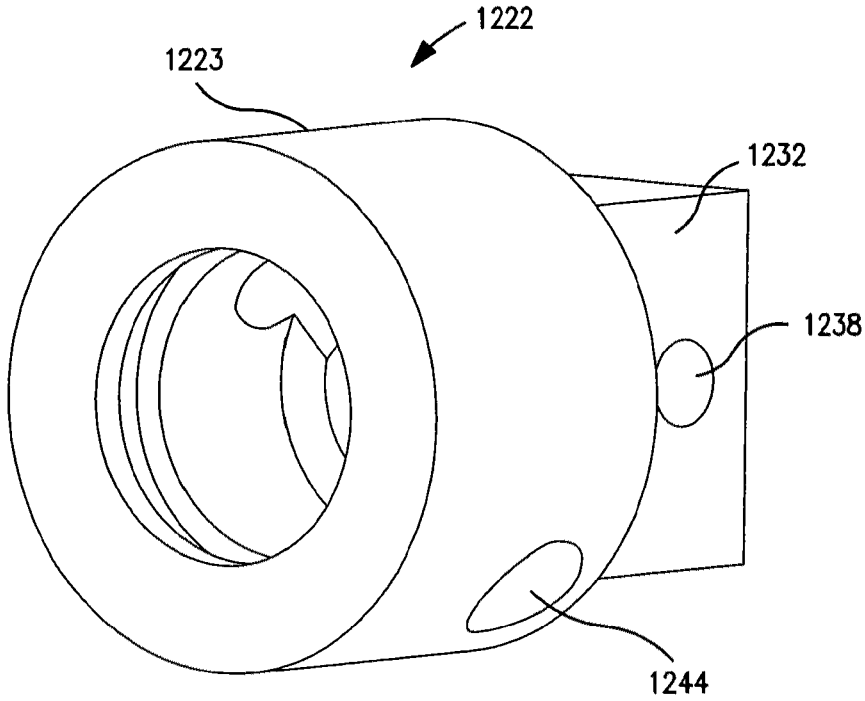
Figure 10C:
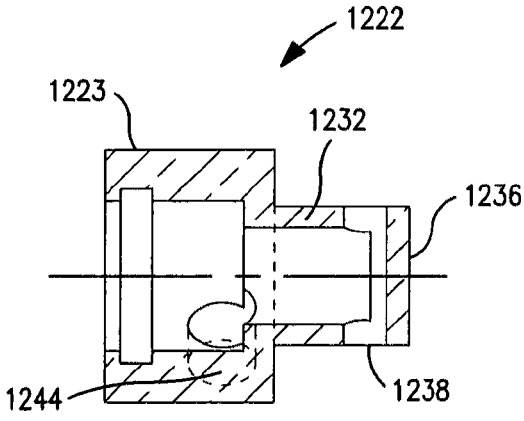
Figure 10D:
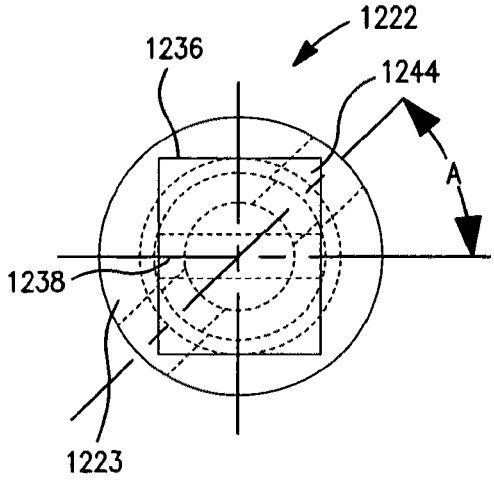

FIGS. 9A-9C illustrate views of the attachment of mount 150 within the optical device 100 shown in FIG. 2A and an exemplary orientation of the array 605 with regard to the vertical axis of optical device 100. Pins 321, 322 provide means for attaching mount 150 to device 100 and setting the orientation of array 605. FIG. 9A illustrates the insertion of mounting 150 in a distal end of the device 100 and is attachment by pins 321, 322. FIG. 9B illustrates a front view of the positioning of array 605 on surface 1108 (FIG. 8) at a preferred angle of substantially 45 degrees to the axis of pins 321, 322. FIG. 9C illustrates a front view of a blueprint representation of the positioning of array 605 on surface 1108. FIG. 9C further illustrates a preferred tolerance for the orientation angle of array 605.

FIGS. 10A-10D illustrate an alternative emitter mounting 1222. Emitter mount 1222, similar to mount 150 (FIG. 8) is a good heat conductor. In this alterative embodiment, emitter mount 1222 is generally in the form of a hollow body, open at one end and closed at the other. Emitter mount 1222 has a major cylindrical wall 1223 at its open end and a bore hole 1244 through outer wall 1223. Bore 1244 may be adapted to receive pins 321, 322 (FIG. 9A). Emitter mount 1222 has a generally rectangular hollow body 1232 defining the closed end of emitter mount 1222. Hollow body 1232 is narrower than major cylindrical wall 1223 and the two are joined by a shoulder 1234. Hollow body 1232 is centered on the axis of major cylindrical wall 1223. A bore hole 1238 through rectangular hollow body 1232 accommodates wiring to an emitter array (not shown) positioned on surface 1236. End wall 1236 is so oriented as to accommodate an emitter at a specified orientation relative to bore hole 1244. In the illustrated example, as may be particularly shown in FIG. 10D, the sides of end wall 1236 are at angle of substantially 45 degrees relative to bore 1244. Similarly, bore 1238 in rectangular body 1236 is at an angle, which in the illustrated embodiment is oriented substantially 45 degrees from bore 1244 in main cylindrical wall 1223.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention.

It is expressly intended that all combinations of those elements that perform substantially the same function in substantially the same way to achieve the same results are within the scope of the invention. Substitutions of elements from one described embodiment to another are also fully intended and contemplated.

What is claimed is:

1. An illuminating headlamp, comprising:

a housing with an open first end and an open second end;

a mounting device coupled to said open second end of said housing, said mounting device comprising:

a substantially cylindrical body with an open end and a closed end;

one or more bores disposed along a central axis of said substantially cylindrical body, and a plurality of raised portions for receiving one or more light emitting devices;

one or more optically transparent lenses disposed at said open first end of said housing, each of said lenses having a focal point; and one or more light emitting devices disposed in said mounting device, said light emitting devices positioned for transmitting light through said one or more optically transparent lenses, wherein said one or more optically transparent lenses are positioned to permit one or more focal points of said one or more optically transparent lenses to focus at a point located behind said one or more light emitting devices, wherein the light projected from said housing is defocused to provide a zone of substantially uniform illumination at a selected distance from said one or more light emitting devices.

2. The illuminating headlamp according to claim 1, wherein said one or more light emitting devices are light emitting diodes (LEDs).

3. The illuminating headlamp according to claim 2, wherein said LEDs are arranged in an array.

4. The illuminating headlamp according to claim 3, wherein said zone of substantially uniform illumination is substantially rectangular.

5. The illuminating headlamp according to claim 3, wherein said zone of substantially uniform illumination is substantially diamond-shaped.

6. The illuminating headlamp according to claim 3, wherein said zone of substantially uniform illumination is substantially square-shaped.

7. The illuminating headlamp according to claim 1, wherein one of said one or more optically transparent lenses is spherical.

8. The illuminating headlamp according to claim 1, wherein one of said one or more optically transparent lenses is aspherical.

9. The illuminating headlamp according to claim 1, wherein one of said one or more optically transparent lenses are composed of glass.

10. The illuminating headlamp according to claim 1, wherein one of said one or more optically transparent lenses are composed of plastic.

11. An illuminating headlamp assembly, comprising:

one or more headlamps, each headlamp comprising:

a housing with an open first end and an open second end;

one or more optically transparent lenses disposed at said open first end of said housing, each of said lenses having a focal point; and one or more light emitting devices disposed in a mounting device, said mounting device being coupled to said open second end, said light emitting devices positioned for transmitting light through said one or more optically transparent lenses, wherein said one or more optically transparent lenses are positioned to permit one or more focal points of said one or more optically transparent lenses to focus at a point located behind said one or more light emitting devices, wherein light projected from said housing is defocused to provide a zone of substantially uniform illumination at a selected distance from said one or more light emitting devices, wherein said mounting device comprises:

a substantially cylindrical body with an open end and a closed end;

one or more bores disposed along a central axis of said substantially cylindrical body, and a plurality of raised portions for receiving one or more light emitting devices; and a head mounting device coupled to said mounting device.

12. The illuminating headlamp assembly according to claim 11, wherein said one or more light emitting devices are light emitting diodes (LEDs).

13. The illuminating headlamp assembly according to claim 12, wherein said LEDs are arranged in an array.

14. The illuminating headlamp assembly according to claim 11, wherein said one or more light emitting devices are arranged in an array, and disposed on said mounting device at an angle of about 45 degrees, relative to the central axis of the cylindrical body.

15. The illuminating headlamp assembly according to claim 11, wherein said one or more light emitting devices are arranged in an array, and disposed on said mounting device at an angle of about 90 degrees, relative to the central axis of the cylindrical body.

16. The illuminating headlamp assembly according to claim 11, wherein said head mounting device comprises a headband.

17. The illuminating headlamp assembly according to claim 11, wherein said mounting device is composed of a heat-conducting material.

18. The illuminating headlamp assembly according to claim 17, wherein said heat-conducting material comprises copper.

* * * * *